United States Patent [19]

Winders

[11] 4,154,299

[45] May 15, 1979

[54] GAS LIFT WELL WITH IMPROVEMENT

[75] Inventor: Ramon E. Winders, Houma, La.

[73] Assignee: Texaco Inc., New York, N.Y.

[21] Appl. No.: 861,790

[22] Filed: Dec. 19, 1977

[51] Int. Cl.[2] ..... E21B 43/00

[52] U.S. Cl. ..... 166/91; 166/95; 166/97

[58] Field of Search ..... 166/91, 95, 97, 314

[56] References Cited

U.S. PATENT DOCUMENTS

| | | | |
|---|---|---|---|
| 1,659,452 | 2/1928 | Welton | 166/95 X |
| 1,791,874 | 2/1931 | Rodgers | 166/95 X |
| 1,798,774 | 3/1931 | Yates | 166/314 X |
| 1,942,598 | 1/1934 | Hewgley | 166/95 X |
| 2,943,640 | 7/1960 | James | 166/91 X |
| 3,139,932 | 7/1964 | Johnson | 166/95 X |
| 3,545,541 | 12/1970 | DeVries | 166/95 |

OTHER PUBLICATIONS

Miller, H. C., *Gas-Lift Method of Flowing Oil Wells,* U.S. Dept of Commerce, Bureau of Mines, Bulletin 323, 1930, pp. 12–15.

*Nixon Surface Control Gas-Lift System,* Wilson Supply Company, 1938, pp. 8a–8h.

*Primary Examiner*—Stephen J. Novosad

*Attorney, Agent, or Firm*—Thomas H. Whaley; Carl G. Ries; Henry C. Dearborn

[57] ABSTRACT

The combination which includes a gas lift well that has a christmas tree coupled to the casing and to the tubing in the well. There is a flow line to receive liquid product and a choke connected between the flow line and the tubing. The improvement includes a lateral Y connected to the top of the tubing with a streamlined flow path connecting a lateral branch of the Y, from the well side of the choke, to the flow line.

6 Claims, 3 Drawing Figures

GAS LIFT WELL WITH IMPROVEMENT

BACKGROUND OF THE INVENTION

1. Field of the Invention

This invention concerns gas lift wells in general. More specifically, it deals with an improved combination of surface elemnts that are connected to a gas lift well, so as to overcome certain difficulties.

2. Description of the Prior Art

It has been found in connection with low pressure flowing wells, and particularly in regard to gas lift operations, that the conventional connection from the well tubing to a flow line which usually includes a choke or small opening in the path of flow for the produced fluids, tends to hold back the flow of liquid product to such an extent that there may be fall-back of liquid being lifted through the well tubing. While it has been suggested that a relatively unrestricted path should be used for connecting the well tubing to a flowline, such suggestion failed to appreciate the potential in connecting a streamlined flow path using a lateral Y therewith so that the choke is by-passed. Furthermore, use of a lateral Y means that the tubing is accessible for using lubricators or the like to operate therein. The indicated prior suggestion is embodied in an article published in the Oil and Gas Journal—June 25, 1973 beginning at page 98 and entitled "How Needed Changes Can Hike Gas-Lift Production."

Consequently, it is an object of this invention to provide an improvement that is applicable to a well head combination for a gas lift well.

SUMMARY OF THE INVENTION

Briefly, the invention concerns the improvement that is in combination with a gas lift well having tubing mounted therein and including a christmas tree mounted at the top of said well. The combination also has a flow line for liquid product being lifted from said well, and a choke connected between said well tubing and said flow line. The improvement comprises a lateral Y coupled to the top of said christmas tree, and a streamlined flow path for said liquid product connected from a lateral branch of said lateral Y to said flow line in parallel with said choke.

Again briefly, the invention concerns the improvement which relates to a combination with a gas lift well having tubing mounted therein and including a christmas tree mounted at the top of said well. The combination also has a flow line for liquid product being lifted from said well, and a choke connected between said well tubing and said flow line. In the foregoing combination, the improvement comprises a lateral Y having a lateral branch and a straight passage therethrough and means for coupling a well tool onto the free end of said straight passage. It also comprises a streamlined flow path comprising an unobstructed conduit having a large radius curvature for connecting said lateral branch to said flow line, and a motor actuated valve coupled into said streamlined flow path. It also comprises means for actuating said valve motor to close said valve if the pressure in said well tubing exceeds a predetermined amplitude, and a pair of check valves connected into said streamlined flow path near the ends thereof, for permitting fluid flow only in the direction from said well tubing to said flow line.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DESCRIPTION OF THE PREFERRED EMBODIMENT

Figures 1, 2, 3:
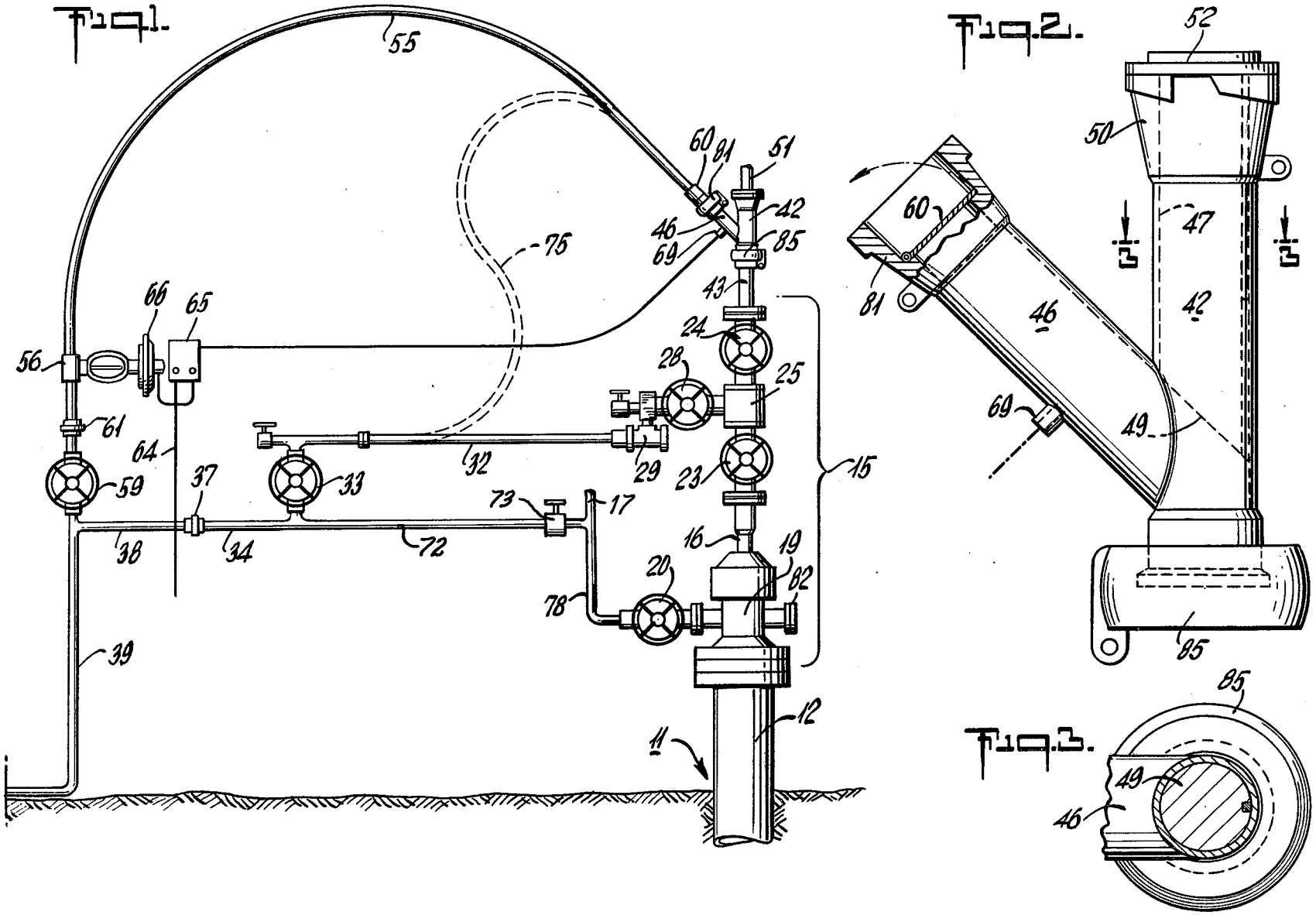
FIG. 1 is a schematic illustration showing the surface connection on a gas lift well which is connected to a flow line for delivering liquid product.
FIG. 2 is an enlarged elevation partly broken away in cross section, illustrating a lateral Y as used in the combination illustrated by FIG. 1.
FIG. 3 is a cross section view taken along the lines 3—3 of FIG. 2 and looking in the direction of the arrows.

Referring to FIG. 1 there is illustrated a well 11 that has surface casing 12 with a conventional christmas tree connected at the top thereof. The term christmas tree conotes a plurality of valves and well head plus T-couplings mounted in a series at the top of a well. In FIG. 1 there is a christmas tree generally indicated by a bracket 15 along side of the elements generally referred to as a christmas tree. These elements are mounted at the top of the casing 12 on the well 11. It may be noted that there is tubing 16 which extends down inside of the casing 12 into the well 11, and through which the produced liquid fluid will flow.

It will be appreciated that since well 11 is a gas lift well, there are mounted down in the hole along the tubing 16, a plurality of gas lift valves (not shown) which act to admit the gas under pressure from the annulus between the casing 12 and the tubing 16. Such gas under pressure may be applied in any feasible manner (not shown), e.g. by being connected to a pipe 17 which is connected to one lateral passage of a well head coupler 19 via a valve 20. The valve 20 is shown coupled onto one lateral of the coupler 19.

Also on the christmas tree 15 which includes a series of valves, flanges, spools and adapters, there are two valves 23 and 24 connected below and above a T-coupler 25. There is another valve 28 conncected to the lateral outlet of the T 25, and on the other side of the valve 28 there is coupled a choke 29. The other side of the choke 29 has a conduit 32 coupled to a valve 33 that has the other side thereof connected through another conduit 34 to a check valve 37. The other side of the check valve 37 is coupled to a conduit 38 that goes to a flow line 39 which handles the product from the well 11.

The elements described so far are conventional, and as so described, make up a known and conventional type of hook-up on a gas lift well. The liquid being produced will flow up through the tubing 16 and out via the choke 29 through the conduits 32, 34 and 38 into the flow line 39. Such a conventional hook-up has been found to have the difficulty that the liquid product being lifted may be sufficiently blocked by the choke 29 so that the liquid or a substantial portion thereof, will not pass on to the product flow line 39. Rather, it will tend to fall back and production will be lost.

In order to overcome the indicated problem, this invention includes a combination in which there is coupled onto the top of the tubing 16, above the valve 24, a lateral Y 42. This is removably coupled to a short extension 43 that connects directly with the tubing 16. The lateral Y 42 has a lateral branch 46 which has a full bore smoothly connected interior passage. The lateral Y 42 also includes a full bore straight passage 47 therethrough. And, there is a coupling union 50 to which a lubricator 51 (schematically indicated) may be attached if desired. Otherwise, a blanking plug 49 for diverting the flow would be attached to a cap 52 which accomodates either such plug or the lubricator 51 (indicated in FIG. 1).

Connected to the end of the branch 46 of the Y 42, there is a streamlined flow path which is made up of a conduit 55. Conduit 55 is shaped into a large radius curvature and it connects via a motor actuated valve 56 to a valve 59 which controls the connection to the flow line 39. In addition there are a pair of check valves 60 and 61 which are connected near the beginning and end of the streamlined flow path through the conduit 55.

The motor actuated valve 56 may be controlled pneumatically, as indicated, and such control will make use of pneumatic pressure line 64 that connects a source of pneumatic pressure (not shown) to a pilot valve 65. The pilot 65 controls the application of pneumatic pressure from the pilot 65 to a diaphragm actuator 66 of the motor valve 56. Pilot valve 65 is controlled by the pressure in the well tubing 16 as taken at a bleeder coupling 69 which taps into the side of the lateral branch 46 of the Y 42.

There is a conduit 72 that connects the above mentioned conduit 34 with the valve 20 via a valve 73 and a conduit 78. Conduit 78 connects the pipe 17 to the valve 20. This conduit 72 connection is only used in case it is desired to bleed off pressure from the casing 12 of the well 11.

An alternative arragnement for providing a streamlined flow path from the lateral Y 42 to the flow line 39, may take the form indicated by dashed lines in FIG. 1. Thus, there would be a double bend conduit 75 connecting the lateral branch 46 with the valve 33. This would be connected instead of the conduit 55 and would not include a motor actuated valve such as the valve 56. Consequently, this alternative would not be employed unless there was no danger of the well developing high pressure of its own i.e. having the well "come in."

It will be appreciated that the check valve 60 might take various forms. For example, as illustrated in FIG. 2, it may be built into a union 81 that is employed at the end of the branch 46 of the lateral Y 42.

It may be observed that an advantage of the use of the lateral Y 42 includes that indicated above, i.e. the ability to couple a lubricator onto the top of the straight vertical passage 47 through the Y. This permits running of tools through the tubing 16 in order to carry out operations such as cutting paraffin, taking bottom hole pressure, servicing safety valves, or the like. When such operations are not being carried out, a blanking plug as indicated above would, of course, be secured in place.

It may be noted that the principal alternative described above which employs the streamlined flow path through the conduit 55, provides for accomodating conditions which may exist should the well "come-in" or develop high pressure. Thus, the pressure tap or bleeder 69 is located on the lateral branch 46 of the Y 42. And, it provides a connection for transmitting pressure to the pilot valve 65. The controls are set so that should the well pressure rise above a predetermined amount, the pilot 65 will be actuated and so cause the motor actuator 66 of the valve 56 to close that valve. Then, the well fluid flowing up through the tubing 16 will be diverted through the conventional path which includes the valve 28 and the choke 29. Consequently, the well fluid flow will be controlled as it flows under natural pressure conditions.

It will be appreciated that the gas lift pressure may be applied to the annulus between the casing 12 and the tubing 16 in the manner indicated above, i.e. through the valve 20 via the indicated conduit 78 and the pipe 17. However, it will be understood that the gas lift supply could be applied through the other side of the well head coupler 19 which is illustrated as being covered by a blind flange 82.

It will be appreciated that the bottom of the lateral Y 42 may be attached to the extension 43 in any feasible manner. For example, a coupling union 85 may be the same type as the unions 50 and 81.

While a particular embodiment of the invention has been described above in considerable detail in accordance with the applicable statutes, this is not to be taken as in any way limiting the invention but merely as being descriptive thereof.

I claim:

1. In combination with a gas lift well having tubing mounted therein and including a christmas tree mounted at the top of said well, a flow line for liquid product being lifted from said well, and a choke connected between said well tubing and said flow line, the improvement comprising a lateral Y coupled to the top of said christmas tree, and a streamlined flow path for said liquid product connected from a lateral branch of said lateral Y to said flow line in parallel with said choke.

2. The invention according to claim 1, wherein said lateral Y has a straight passage therethrough and means for coupling a well tool onto the free end thereof.

3. The invention according to claim 2, wherein said streamlined flow path comprises an unobstructed conduit having a large radius curvature for connecting said lateral branch to said flow line.

4. The invention according to claim 3, also comprising a motor actuated valve coupled into said streamlined flow path, and means for actuating said motor to close said valve if the pressure in said well tubing exceeds a predetermined amplitude.

5. The invention according to claim 4, also comprising a pair of check valves connected into said streamlined flow path near the ends thereof for permitting fluid flow only in the direction from said well tubing to said flow line.

6. In combination with a gas lift well having tubing mounted therein and including a christmas tree mounted at the top of said well, a flow line for liquid product being lifted from said well and a choke connected between said well tubing and said flow line, the improvement comprising a lateral Y coupled to the top of said christmas tree and having a lateral branch and a straight passage therethrough and means for coupling a well tool onto the free end of said straight passage, a streamlined flow path comprising an unobstructed conduit having a large radius curvature for connecting said lateral branch to said flow line, a motor actuated valve coupled into said streamlined flow path, means for actuating said valve motor to close said valve if the pressure in said well tubing exceeds a predetermined amplitude, and a pair of check valves connected into said streamlined flow path near the ends thereof for permitting fluid flow only in the direction from said well tubing to said flow line.

* * * * *